US006513555B1

(12) United States Patent
Lesser et al.

(10) Patent No.: US 6,513,555 B1
(45) Date of Patent: Feb. 4, 2003

(54) METHOD AND DEVICE FOR AUTOMATICALLY BINDING BUNDLES OF CABLES

(75) Inventors: Hans-Jurgen Lesser, Rheinfelden (DE); Martin Busch, Efringen-Kirchen (DE)

(73) Assignee: A. Raymond & Cie, Grenoble (FR)

( * ) Notice: Subject to any disclaimer, the term of this patent is extended or adjusted under 35 U.S.C. 154(b) by 0 days.

(21) Appl. No.: 09/868,357

(22) PCT Filed: Dec. 8, 1999

(86) PCT No.: PCT/EP99/09642

§ 371 (c)(1),
(2), (4) Date: Jun. 15, 2001

(87) PCT Pub. No.: WO00/38991

PCT Pub. Date: Jul. 6, 2000

(30) Foreign Application Priority Data

Dec. 23, 1998 (DE) ..... 198 59 672

(51) Int. Cl.[7] ..... B21F 9/02
(52) U.S. Cl. ..... 140/123.6; 140/93.2
(58) Field of Search ..... 140/93 A, 93.2, 140/123.6

(56) References Cited

U.S. PATENT DOCUMENTS 3,391,440 A * 7/1968 Harms ..... 140/123.6
3,865,156 A * 2/1975 Moody et al. ..... 140/123.6
4,908,911 A * 3/1990 Bretti et al. ..... 140/93.2
5,769,133 A * 6/1998 Dyer et al. ..... 140/123.6

FOREIGN PATENT DOCUMENTS

| | | | |
|---|---|---|---|
| DE | 42 12 789 | * | 9/1993 |
| EP | 297337 | * | 1/1989 |
| EP | 839717 | * | 5/1998 |
| FR | 2223141 | * | 10/1974 |

* cited by examiner

*Primary Examiner*—Lowell A. Larson

(57) ABSTRACT

A device for binding bundles of cables uses a continuously fed cable tie to bind the cables. The cable tie is wound around the bundle of cables by guide claws. The cable tie is secured by a latching lock which can be positioned in front of the guide claws. The cable tie is then cut off in a non-tensioned state behind the latching lock. While bundling the cables, a fastener can be positioned at the bundling location next to the latching lock if necessary. The fastener is configured so as to anchor the loom of cables to a support element. A carriage which can be shifted in the binding device, positions the latching locks and fasteners. The carriage includes holding jaws and a carrier which clutches the locks and fasteners fed from above. The carriage carries the parts to the outlet of the device at the transition area to the guide claws of the device. A feed channel is provided in the carriage. Said feed channel overlaps with the outlet of the insertion channel for the cable tie in the housing when the carriage moves forward. In this position, the cable tie can be pushed through the latching lock because an insertion tab which is connected to the carriage.

28 Claims, 6 Drawing Sheets

METHOD AND DEVICE FOR AUTOMATICALLY BINDING BUNDLES OF CABLES

FIELD OF THE INVENTION

The present invention pertains to a method for automatically binding bundles of cables, where a continuously fed cable tie with teeth or grooves on one of its surfaces is advanced by a motor and its leading end is inserted into a lock that is provided with a locking means. The cable tie is then wound around a cable bundle and reinserted into the lock, whereafter the cable tie is tensioned by reversing the direction of feed relative to its original direction of advance and the tie is cut behind the lock. The invention also pertains to an automatically operating device for carrying out this method.

BACKGROUND OF THE INVENTION

An automatic cable strap binding devise is shown in EP 0 297 337 A1. However, this device has various disadvantages. The automatic binding process is triggered with an actuating lever and is carried out by a complicated mechanism. The mechanism has numerous individual parts that are designed relative to one another for the various production steps, and thus, this device is very susceptible to malfunctions. The complicated mechanism causes the process to be carried out relatively slowly. The locks are connected to one another like a chain by means of connecting pieces. They are cyclically fed from the bottom with a mechanical drive that is connected to the actuating lever. Consequently, the locks are fed against the force of gravity. The locks are moved into a temporary position, in which they are taken hold of by a horizontally movable carriage. The carriage also contains a guide channel for supplying the continuous cable tie. The locks are ultimately positioned at the outlet opening of the device and in front of the guide channel for the cable tie. The initial positioning of an individual lock in front of the carriage against the force of gravity, is not reliable because there is no defined limit stop. Consequently, it cannot be guaranteed that the ensuing production steps are carried out error-free.

The binding device of EP 0 297 337 A1 uses a certain design of the lock for tensioning the cable tie and the cable tie design matches this lock design. One surface of the cable tie contains two teeth that are parallel but are directed opposite to one another. The locks are essentially cuboid and have through holes with matching locking tabs protruding from the opposing surfaces. These locking tabs contain matching locking teeth that each extend over half the width of the locking tabs and that are laterally offset, with the locking teeth being able to engage with the teeth of the cable tie. Once a lock is correctly positioned in the opening and aligned relative to the guide channel for the cable tie in the carriage, the cable tie is pushed forward and through the opening in the lock in a motor-driven fashion. The end of the cable tie slides along guide jaws that close around a cable bundle until the tie loops entirely around the cable bundle and is reinserted into the lock. The end of the cable tie now must be guided through the opening of the lock in the opposite direction, wherein the locking tabs should engage with opposing teeth in the cable tie. Subsequently, the cable tie is tensioned by reversing the drive until the cable bundle within the cable tie loop is pulled together tightly and the ends of the tie protruding backwards from the lock are cut off.

Malfunctions may occur, in particular when the leading end of the cable tie is reinserted into the opening of the lock after it has slid along the guide jaws. The cable tie must loop 360 degrees around the cable bundle and its end must then be returned into the opening of the lock at an acute angle. After the looping process, the leading end of the cable tie impacts the rest of the tie in front of the opening of the lock at an obtuse or right angle. In order to accomplish an insertion at an acute angle, the leading end is deflected in such a way that it is pushed into the opening. Since there is no defined limit stop for the end of the cable tie, it cannot be controlled whether the end is actually inserted into the opening and sufficiently advanced therein in order to ensure a reliable engagement of the locking tabs with the teeth of the cable tie. The end may protrude into the guide channel for the cable tie and thus cause malfunctions in the device after being cut as waste that cannot be removed.

The process of cutting the cable tie behind the lock takes place while the cable tie is still subjected to the tension required for the tensioning process. Practical experience demonstrates that the short end of the cable tie which is cut behind the lock may jump out of the lock such that the entire binding process is unsuccessful and must be repeated.

In certain instances, it is necessary to mount the bundled cables, e.g., on a carrier part or a housing wall, at certain intervals with the aid of special fastening means. The known device does not provide the option of attaching such fastening means to the cable bundles.

SUMMARY OF THE INVENTION

The present invention is based on the objective of developing a binding device that operates reliably, quickly, and without any malffunctions. After the cable tie is looped around the cable bundle and the cable tie is tightened, a reliable engagement between the locking tabs in the lock and the cable tie must be ensured, such that the engagement cannot be loosened or separated at all after the cable tie is cut behind the lock. In addition, it should be possible, if so required, to arrange a fastening means on the cable tie for anchoring the cable bundle on a carrier part simultaneously with the binding of the cable bundles.

According to the present invention, the objectives are attained due to the fact that the drive of the cable tie is stopped before the cable tie is cut such that the cable tie behind the lock is no longer subjected to tension. Therefore, the end of the cable tie will not jump out of a tooth of the locking means in the lock and will not jump completely out of the lock when the cable tie is subsequently cut.

The control of the driving motor of the cable tie and the interruption of the cable tie drive preferably take place as a function of measured values. This is achieved, in particular, by measuring the power consumption or the torque of the driving motor.

The measured value for controlling the driving motor may also be obtained in the form of a distance measurement during the advance of the cable tie. This second measured value may also serve for control purposes. Consequently, the locking means of the lock reliably engages with the grooves of the cable tie, and the cable tie cannot become loose or separate at all. In addition, the cable tie is always cut at a defined position, and the newly created end of the cable tie is reliably taken hold of in the lock during the next advance movement. The locking teeth and the grooves of the cable tie can never be positioned "tooth-on-tooth."

In an automatically operating binding device, a motor-driven carriage according to the present invention can be moved back and forth in the housing. A guide channel for the cable tie ends at the upper side of the carriage, with the opening of the guide channel being covered by an insertion tab. Lateral holding jaws, between which a lock can be placed, are provided at the leading end of the carriage. The lock has a through-channel which is aligned with the insertion tab. The lock also includes an insertion channel that is open toward the bottom and offset by 90 degrees relative to the through-channel. The through-channel and the insertion channel each include locking tabs for engaging the teeth or grooves of the cable tie. At the end of the. advance movement of the carriage, the lock, which is held between the holding jaws, is placed in an outlet opening of the housing. Guide jaws include a guide groove that is aligned with the inlet end of the through-channel in the lock when the jaws are closed. The groove is aligned with the insertion channel of the lock at its outlet end. The insertion tab can be inserted into the through-channel in order to raise the locking tab such that the cable tie can be advanced in a motor-driven fashion underneath the insertion tab. The tie goes through the through-channel and along the guide groove, until it reaches the insertion channel of the lock and is able to engage the locking tab.

The housing has an outlet opening, which aligns with the guide channel when the carriage is in the advanced position.

Once the leading end of the cable tie engages in the insertion channel of the lock, the drive motor for the cable tie is switched from feeding to tensioning. The drive of the cable tie is entirely stopped once a certain tensile force is reached. Subsequently, a cutting device is actuated, wherein the knife of the cutting device moves perpendicular to the direction of advance of the cable tie behind the lock. The carriage is then returned to its starting position.

A supply tube for the locks advantageously extends into the device from the top, with the opening of the supply tube being situated directly above the space limited by the holding jaws of the carriage. Due to this measure, the locks can be reliably positioned and do not have to be transported against the force of gravity.

According to one preferred embodiment of the device according to the invention, holding devices are provided in the housing on both sides of the outlet opening. Fastening means are supplied from the top and are used for mounting the cable bundle on a carrier part. The fastening means are placed on the holding devices. A head part of these fastening means protrudes downward into the moving path of the carriage through the holding devices and contains an eyelet that is aligned with the through-channel of the lock. The fastening means are taken hold of by the carriage during its advance and moved into position in the outlet opening. Due to this measure, it is possible to bundle the cables and, if so required, attach fastening means for the cable bundle in one production step.

In order to ensure that the fastening means can be reliably driven during the carriage movement and then placed at the appropriate position, a driver is advantageously provided on the carriage. During the forward movement of the carriage, this driver engages a protruding collar of the fastening means.

A first pair of holding clamps for the lock and a second pair of holding clamps for the fastening means may be arranged in the device on both sides of the outlet opening in order to ensure the correct positioning of the lock and the fastening means in the outlet opening.

The device for supplying the fastening means, including an ejection channel for transport strips that are separated from the fastening means, is preferably arranged in an interchangeable module that can be removed from the device. If the cable bundle does not have to be anchored on a carrier part, the interchangeable module can be removed from the device and replaced with a cover.

The guide jaws surrounding the cables to be bundled are preferably closed and opened manually, with all other steps of the device being program-controlled after a trigger is actuated.

The switching of the cable tie driving motor from feeding to tensioning may also be defined by the measurable advance of the cable tie. For this purpose, a light barrier can be provided in the device within the region of the starting position or zero position of the cable tie.

A method using the device according to the invention preferably consists of the following steps:

- initiating an operating cycle after the sensor has recognized a binding point for a cable bundle, with a lock being placed between the holding jaws of the carriage,
- releasing or blocking the supply of fastening means after the sensor has recognized a mounting point for the cable bundle on a carrier part,
- advancing the carriage to the working position of the lock and, if applicable, to that of the fastening means,
- advancing the slide on the carriage and inserting the insertion tab into the through-channel of the positioned lock,
- advancing the cable tie until it is inserted into the insertion channel and engaged with the locking means provided therein, during which a continuous measurement of the power consumption of the cable tie driving motor takes place,
- switching the driving motor from feeding to tensioning as a function of the measured value, during which the continuous measurement of the power consumption of the driving motor continues,
- returning the slide to its relative starting position on the carriage,
- stopping the driving motor as a function of the measured value in order to remove tension in the cable tie behind the lock,
- actuating the cutting device for cutting the cable tie behind the lock,
- pulling the cable tie back to its starting position, and
- returning the carriage to its starting position.

BRIEF DESCRIPTION OF THE DRAWINGS

The invention is described in greater detail below with reference to the following Figures.

DETAILED DESCRIPTION OF THE PREFERRED EMBODIMENTS

Figure 1:
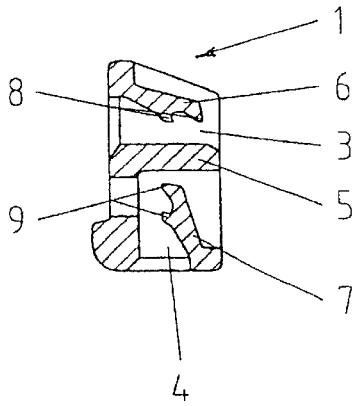
FIG. 1 is a longitudinal cross-sectional view of a lock for use with the present invention.
Figure 2:
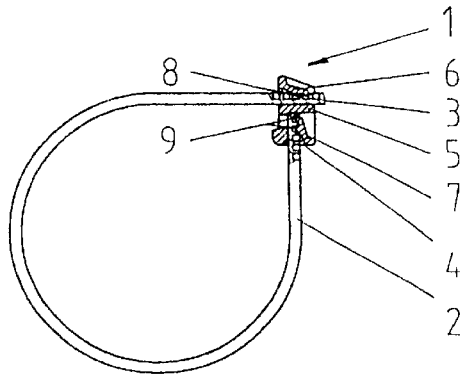
FIG. 2 is a longitudinal cross-sectional view of the lock according to FIG. 1 with an inserted cable tie.
Figure 4:
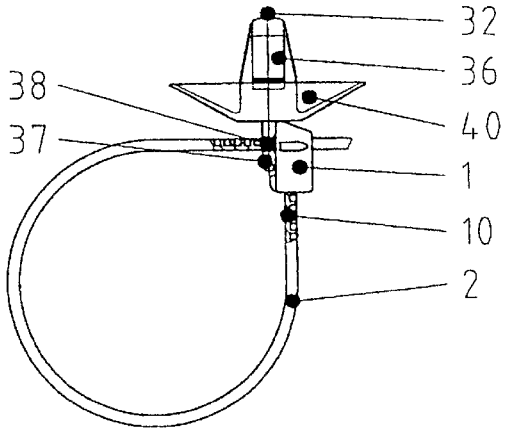
FIG. 4 is a side elevational view of the lock of FIG. 1 with a fastener according to FIG. 3 provided thereon in accordance with the invention, and with a cable tie that is inserted into both parts.

A lock 1 for a cable tie 2 which is shown in FIGS. 1, 2 and 4 is preferably used with an automatic binding device according to the present invention. This lock essentially consists of a cuboid housing, in which there is a through-channel 3 and an insertion channel 4 that extend at right angles to one another. The insertion channel 4 is separated from the through-channel 3 by a wall 5. As described in greater detail below, this wall 5 forms a limit stop for the leading end of a cable tie 2. Flexible locking tabs 6, 7 are provided in the through-channel 3 as well as in the insertion channel 4, with the locking tabs being able to engage teeth 8, 9 on one surface of the cable tie 2, which is provided with a sawtooth pattern or grooves 10.

Figure 5:
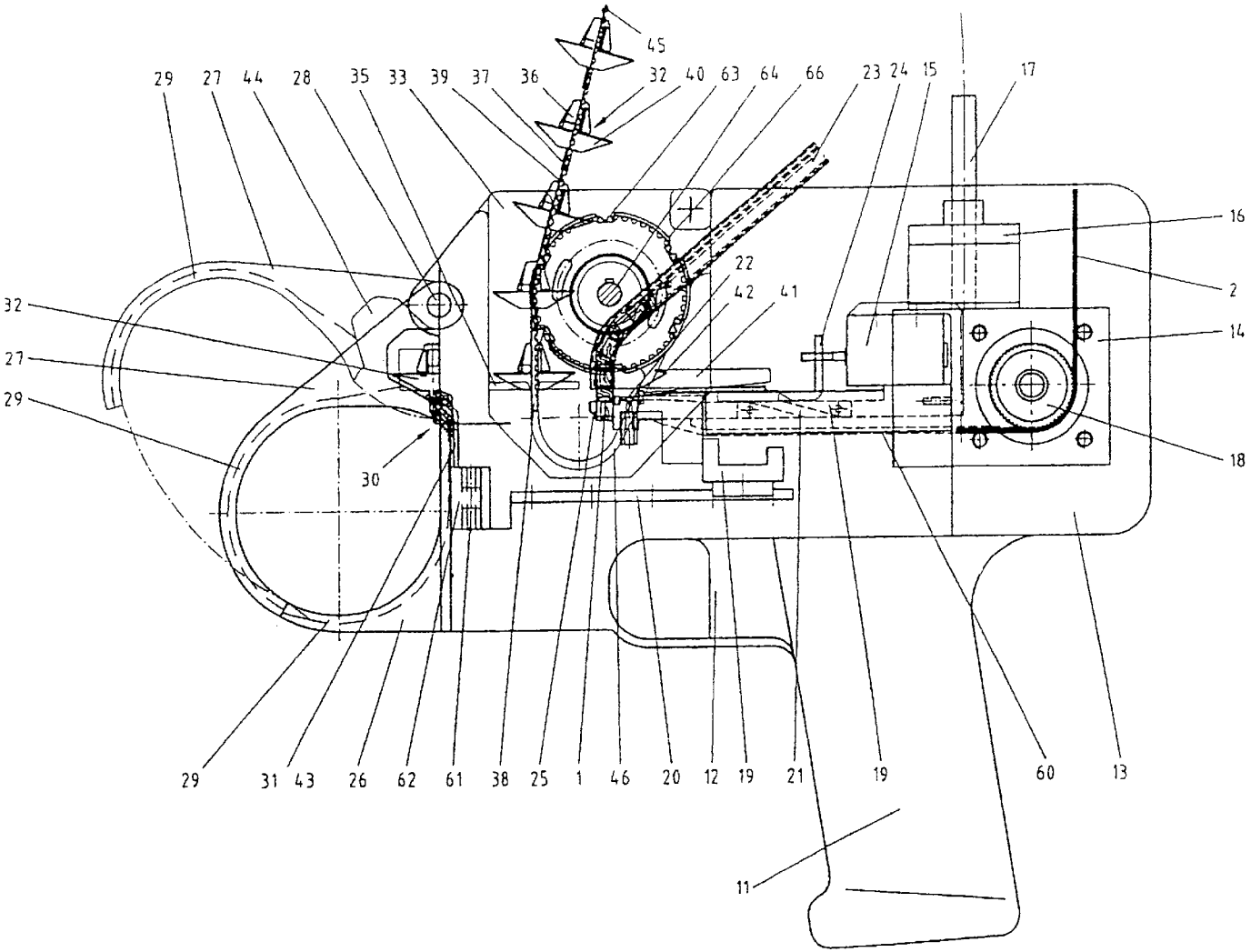
FIG. 5 is a partially sectioned side view of one preferred embodiment of a device according to the present invention with an interchangeable module for attaching fasteners according to FIG. 3 onto a cable bundle.

FIG. 5 shows a partially sectioned side view of a binding device according to the present invention. The housing 13 of the device has the shape of a pistol with a handle part 11 with a trigger 12. A processing cycle of the device can be initiated by actuating this trigger. A gear 14 and a brake 16 for the drive of the cable tie 2 are provided in the rear part of the housing 13. In the embodiment shown, the drive is realized with the aid of an external electric motor via a flexible shaft 17. However, it would also be conceivable to integrate the electric motor into the housing.

The gear 14 drives a pinion 18 that is laterally arranged in the housing. A continuously fed cable tie 2 is unwound from a supply roll (not shown) and is placed about the pinion such that the teeth of the pinion 18 engage the teeth or grooves 10 of the cable tie 2, and the cable tie 2 can be transported or advanced by driving the pinion 18. A carriage 19 is guided on guide rails 20 in the housing 13 such that it can be moved longitudinally back and forth. The drive of the carriage 19 may be, for example, a Bowden cable (not shown) that moves in both directions or the carriage can be returned to its starting position with the aid of a return spring.

The carriage 19 includes an obliquely extending continuous guide channel 21. When the binding device is actuated (see below), this guide channel 21 is positioned such that it aligns with the outlet opening of an insertion channel 60, through which the cable tie 2 is fed from the pinion 18. A slide 24 is movably mounted on the upper side of the carriage 19, with an insertion tab 22 of preferably spring-like material being mounted on the slide. The free end of this insertion tab extends beyond and consequently covers the outlet opening of the guide channel 21 in the carriage 19 and abuts against the upper side of the carriage 19 in a spring-like manner. The slide 24 is driven by an electromagnet 15 in order to realize its movement on the carriage 19.

Lateral holding jaws 25 are provided on the leading end of the carriage 19. A supply tube 23 for the locks 1 according to FIG. 1 leads into the housing 13 from the top and is arranged above the holding jaws. The locks 1 can be advantageously fed individually through the supply tube 23 from a loosely piled supply after they have been separated, for example, into single units by a feed screw (not shown) or another suitable device, if so required, by means of compressed air. The individual locks 1 drop into the space between the holding jaws 25 and are held in a temporary position by the holding jaws. Alternatively, the locks 1 may also be fed by means of a transport strip that is preferably reused in order to prevent waste.

Guide jaws 26, 27 are arranged on the leading end of the housing 13, such that one guide jaw 26 is stationary, and the other guide jaw 27 can pivot about an axis 28 on the housing 13. In this way, the guide jaws 26, 27 can be opened and closed similar to tongs. In the closed position, the guide jaws form a closed, approximately circular inner guide groove 29. In FIG. 5, both positions of the pivoting guide jaw 27 are illustrated with bold lines of different widths.

An outlet opening 30 is arranged in the housing 13 of the device such that it is aligned with the leading end of the carriage 19. The outlet opening ends in the space enclosed by the guide jaws 26, 27, preferably slightly underneath the pivoting guide jaw 27 or its guide groove 29. The outlet opening 30 has such a shape that it is able to accommodate the holding jaws 25 of the carriage 19 as well as the lock 1 held therein. A first pair of spring clamps 31 are fixed such that they can pivot about axes 61 of pivoting jaws 62 and are arranged in the housing 13 on both sides of the outlet opening 30. When a lock 1 is inserted into the outlet opening 30 by the carriage 19, the pivot jaws 62 pivot due to slanted surfaces arranged on the leading end of the carriage 19 and the spring clamps 31 laterally contact the lock 1 and thus hold the lock in position (see below, as well as FIGS. 7*a*–7*f* and FIG. 9).

Figure 6:
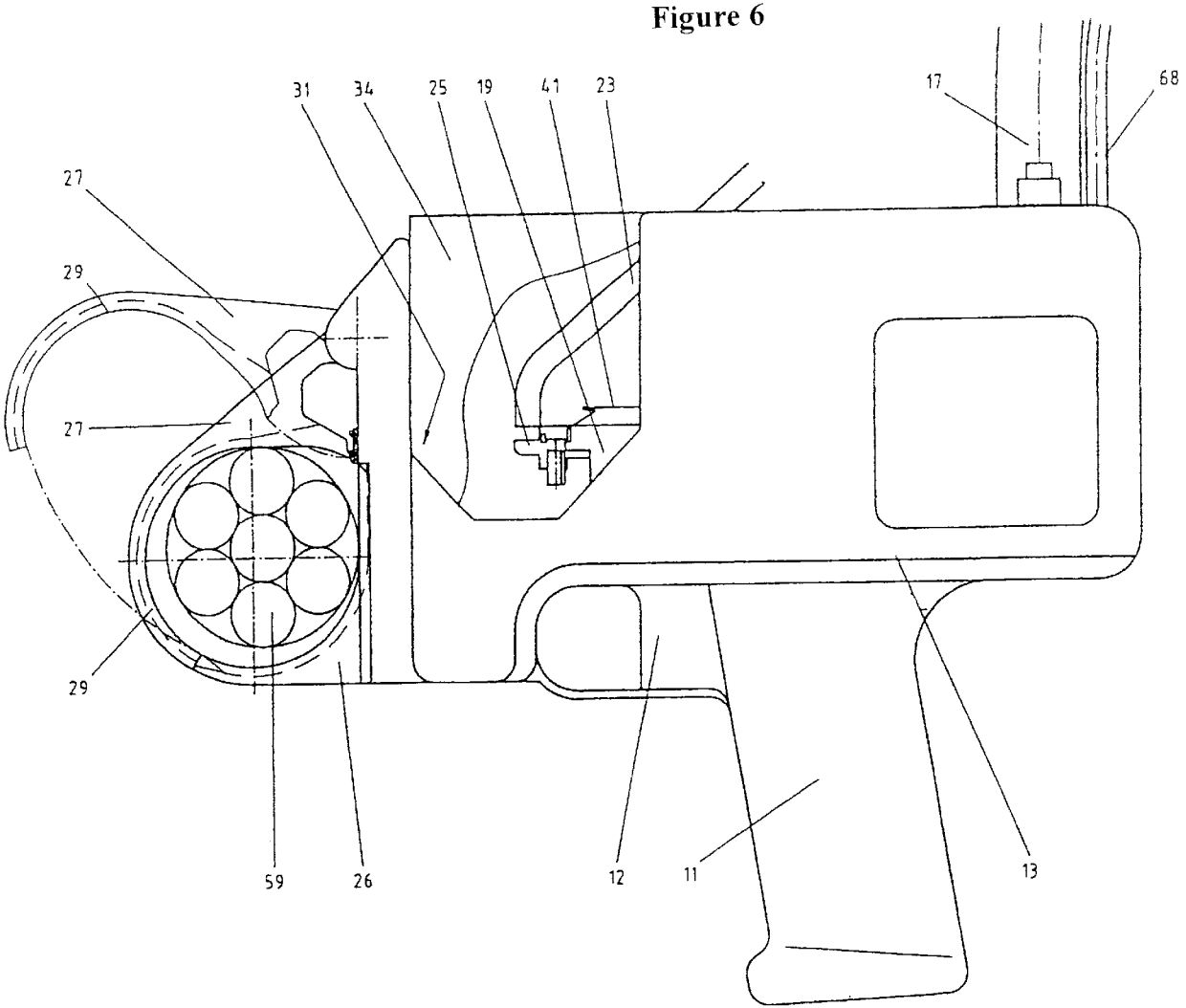
FIG. 6 is a side view of the device of FIG. 5 with the interchangeable module removed.

The device makes it possible to attach fastening means 32 for anchoring the cable bundle on a carrier part at binding points for the cable bundle at different programmable distances. This attachment of fastening means 32 can be carried out simultaneously with the binding process in one production step, i.e., simultaneously with the attachment and tensioning of the cable tie 2. For this purpose, the device is equipped with a special interchangeable module 33 that can be inserted into the front region of the device if so required. FIG. 6 shows the device with the interchangeable module 33 removed. A recess in the housing 13, is used to accommodate the interchangeable module 33. In FIG. 6, the recess is closed with a correspondingly shaped cover 34 in order to protect the interior of the housing and, in particular, the movable parts, from becoming soiled. In FIG. 6, part of the cover 34 is not shown such that the supply tube 23 for the locks 1 and the leading end of the carriage 19 are visible.

When the interchangeable module 33 is inserted into the device, as shown in FIG. 5, the fastening means 32 can be supplied to the device from the top. The fastening means are placed in front of the carriage 19 in the starting position of the device. For this purpose, lateral holding arrangements 35, on which the fastening means 32 can be placed, are provided in the interchangeable module 33.

Figure 3:
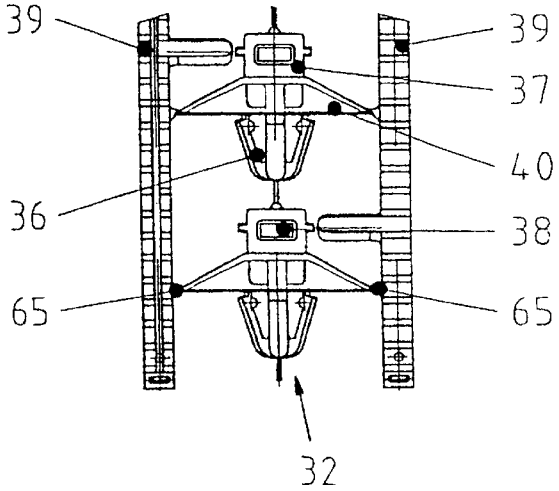
FIG. 3 is a view of fasteners which are used for anchoring a cable bundle on a carrier part with the fasteners connected into a strip such that they can be processed with a device according to the present invention.

One possible embodiment of the fastening means 32 is shown in FIG. 3 together with a suitable transport element. The fastening means 32 consist of a spring-like mounting leg 36 for anchoring the cable bundle on a carrier part, as well as a head part 37 that is provided with an eyelet 38 or a slot for inserting the cable tie 2. In order to realize an automatic feed of the fastening means 32, they are connected to one another in a row by strips 39 that are attached to an umbrella-like collar 40 between the head part 37 and the mounting leg 36 during the casting process. The strips 39 are used as transport elements for feeding the fastening means 32 to the device from a supply roll. For this purpose, the strips 39 may be provided with teeth 45 that can engage gears 63 arranged on both sides in the interchangeable module 33. Differently designed fastening means can be fed analogously. Cutting disks 66 are preferably arranged parallel to the gears 63 and on the same drive shaft 64. During the advance of the fastening means 32, these cutting disks separate the fastening means from the strips 39 at setbreaking points 65 (see FIG. 3) or at least cut the setbreaking points 65.

FIG. 5 shows that the fastening means 32, which are fed as described above, are placed onto the holding arrangements 35 with their collar 40 in such a way that the head part 37 with its eyelet 38 is located in the moving path of the holding jaws 25 of the carriage 19. As described in greater detail below, with reference to FIGS. 7*a*–7*f*, the head part 37, with its eyelet 38 contacts the lock 1 transported between the holding jaws 25 of the carriage during the forward movement of the carriage 19. In addition, a driver 41 is provided on the carriage 19. This driver engages a notch 42 on the collar 40 of the fastening means 32 and holds the fastening means in such a position that they participate in the additional movement of the carriage 19. During this process, the fastening means 32 are separated from the strips 39 used as the transport element at the notched setbreaking points 65. At the end of the forward movement of the carriage 19, i.e., when the lock 1 is placed into the outlet opening 30 of the device, the fastening means 32 are partially pushed through the matching outlet opening 30, as indicated in FIG. 5. The fastening means are additionally held at this location by a second pair of spring clamps 43 arranged adjacent to the first pair of spring clamps 31 in the pivoting jaws 62 lateral to the outlet opening 30 (see also FIG. 9). A recess 44, in which the fastening means 32 can be accommodated in this position, is provided in the pivoting end of the guide jaw 27.

An ejection channel 46 is provided within the interchangeable module 33. During the advance of the fastening means 32, the strips 39 that are separated from the fastening means in a cyclical fashion are guided through this ejection channel and transported out of the device, whereafter they can be delivered to a recycling facility.

Figure 8:
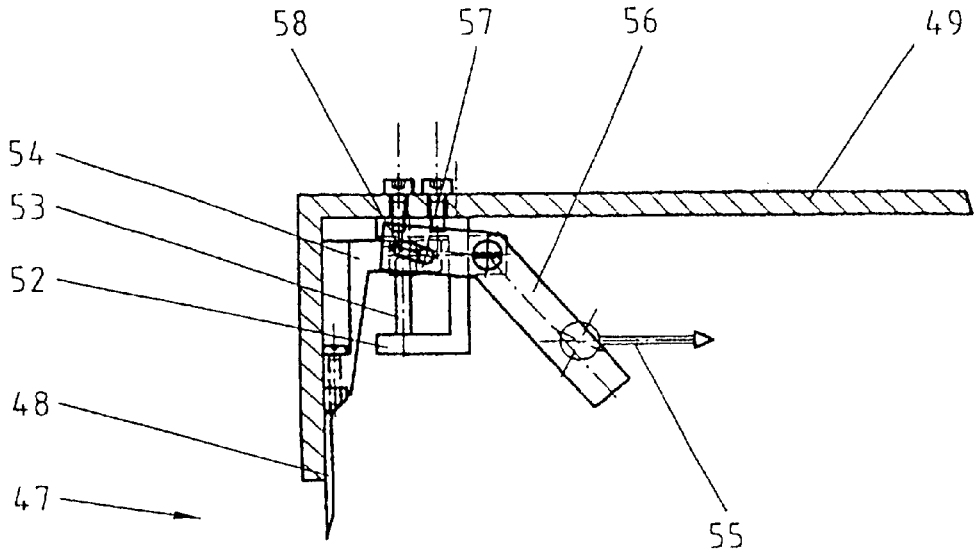
FIG. 8 is a top view of one embodiment of a cutting device used in the device according to the present invention.
Figure 9:
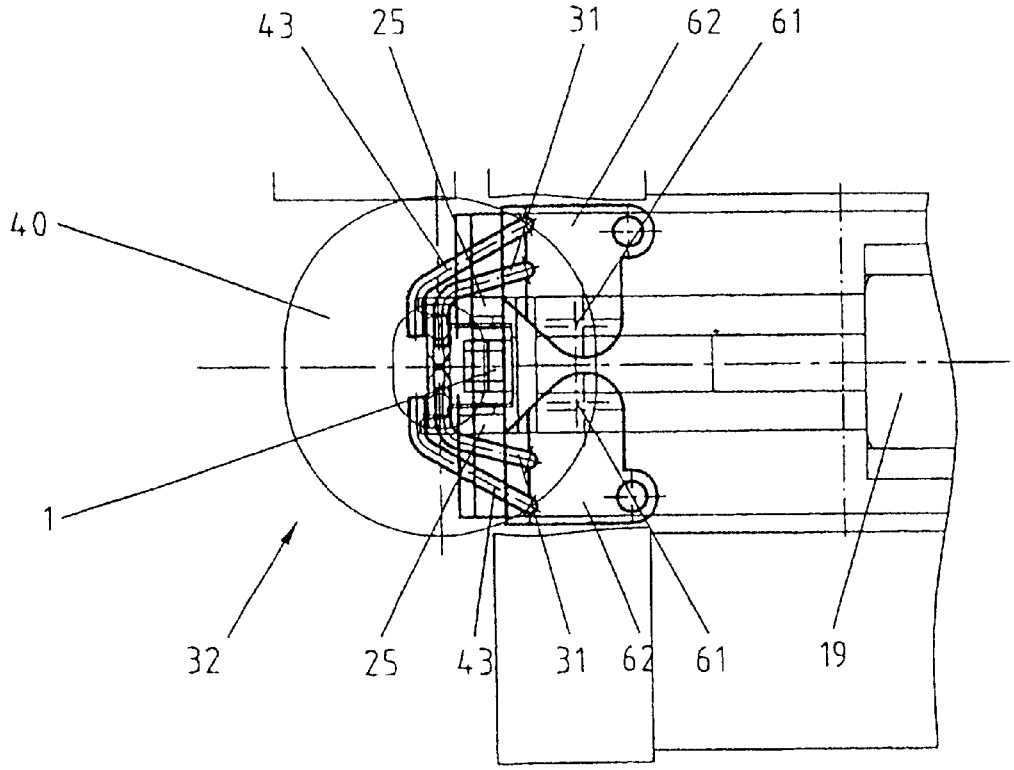
FIG. 9 is a top view of a detail of the device within the region of its outlet opening.

A cutting device 47, which can be seen in a top view in FIG. 8, is provided laterally in the housing 13 of the device adjacent to the outlet opening 30. This cutting device is arranged in the housing 13 in such a way that its knife 48 can be moved horizontally and vertically relative to the plane of projection of FIGS. 5 and 6 at the end of one operating cycle. It is moved directly behind the outlet opening 30 or the lock 1 located therein. Consequently, the cable tie 2 can be cut a short distance behind the lock 1. Due to this measure, the consumption of cable tie 2 is limited to the actually required amount and no waste is created.

In the embodiment of the cutting device 47 shown in FIG. 8, an U-shaped component 52 is screwed into the lateral housing wall 49. A guide rod 53, on which an angled carrier part 54 of the knife 48 can be moved, is arranged between the two legs of the U. A lever 56 that can be actuated by means of a Bowden cable 55 engages on the foot of the carrier part 54. The connection between the lever 56 and the foot of the carrier part 54 is made by means of a pin 57 in an oblong hole 58. The Bowden cable 55 is driven in a program-controlled fashion by an external motor.

The function of the device will now be described in greater detail with reference to FIGS. 7*a*–7*f*, which show a sequence of production steps during one operating cycle of the device. In this case, it is assumed that the cable tie 2 is inserted through a housing slot 67 and placed around the pinion 18, with the leading end of the cable tie being inserted into the insertion channel 60. It is also assumed that the feeding of locks 1, as well as the feeding of fastening means 32, can be actuated here. The start and the sequence of processing steps of the device largely take place in a program-controlled fashion.

Figure 7A:
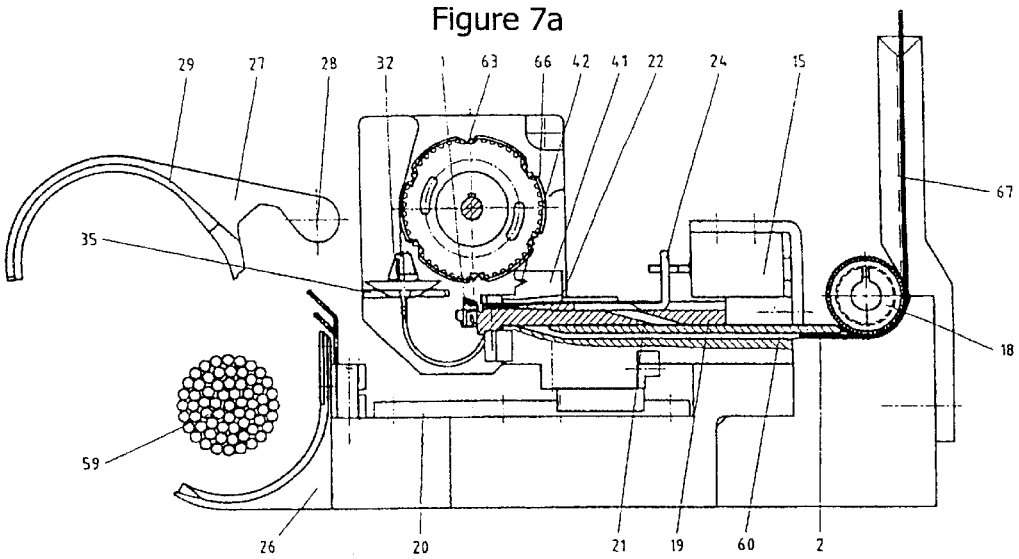
FIGS. 7*a*–7*f* are schematic side views of the front region of the device of FIG. 5 in different successive actuation stages.

Initially, the device is moved into a predetermined position for cables strands 59 to be bundled and fastened on a carrier part while the guide jaw 27 is open. A sensor on the device identifies this position by means of a coding system, and the received signal is compared with a predetermined signal. If both signals agree with one another, the feeding of locks 1 through the supply tube 23 and the transport of fastening means 32 by the gears 63 and the strips 39 used as the transport means are automatically initiated. A lock 1 is then placed between the holding jaws 25 on the leading end of the carriage 19, and one fastening means 32 lies on the holding arrangements 35 in front of the outlet opening 30 (FIG. 7*a*). In this case, the feeding of locks 1 is realized in such a way that their through-channel 3 is aligned with the insertion tab 22 on the slide 24, with the opening of the insertion channel 4 pointing downward.

If the above-mentioned signals do not agree with one another, the lock 1 and the fastening means 32 are not positioned as described above and a programmed start of the device cannot take place.

Figure 7B:
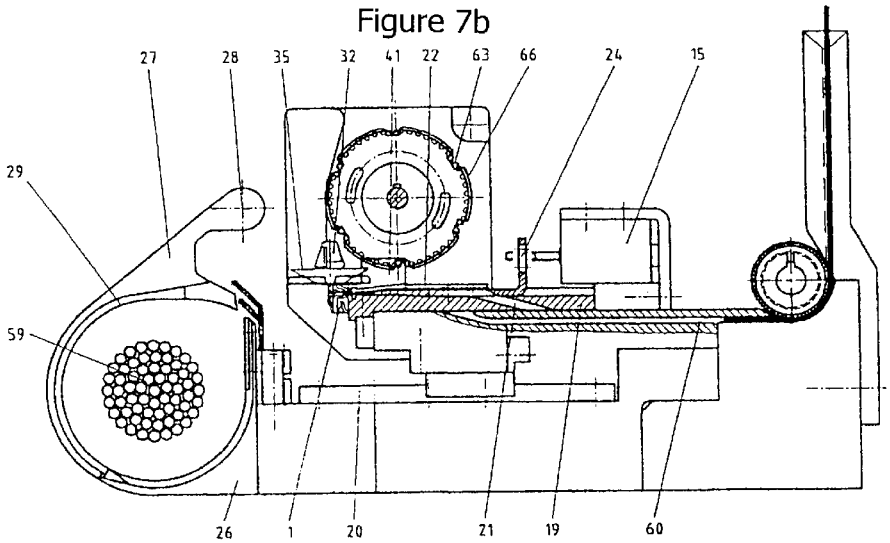
Figure 7C:
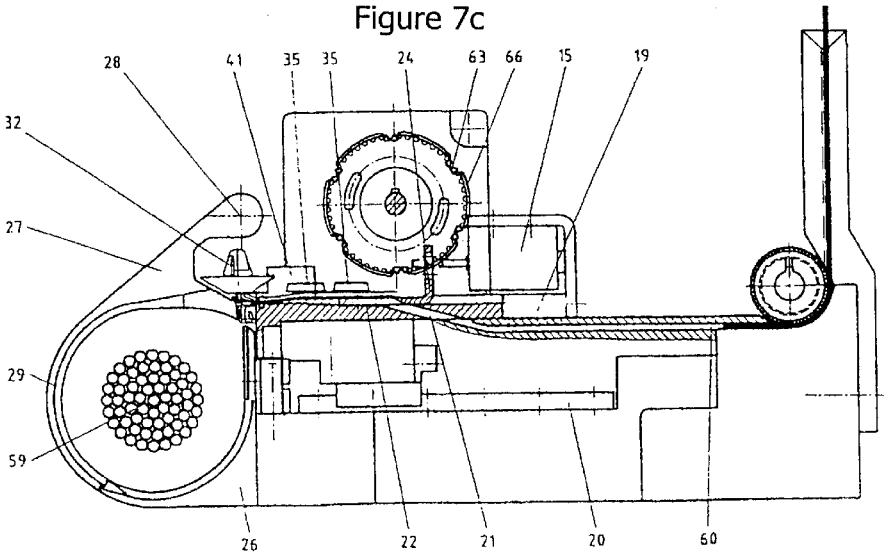

If the position of the device is determined to be correct, the guide jaws 26, 27 are manually closed around the cables 59 to be bundled and locked. Subsequently, the trigger 12 of the device is actuated such that an electric signal for the program start is generated. The carriage 19 is initially moved forward in accordance with the program, such as by a Bowden cable, with the carriage also advancing the lock 1 held by the holding jaws 25. In FIG. 7*b*, the carriage 19 has reached the intermediate position in which the head part 37 of the fastening means 32 contacts the lock 1 between the protruding holding jaws 25 of the carriage 19 in such a way that the eyelet 38 of the head part 37 is located at the same elevation as the through-channel 3 of the lock 1. In addition, the notch 42 on the driver 41 of the carriage 19 engages around the circumference of the collar 40 of the fastening means 32 such that the fastening means 32 is also held in position after being separated from the strip 39. The carriage 19 continues to move forward until the lock 1 and the fastening means 32 are placed in the outlet opening 30 of the device, as shown in FIG. 7*c*. In this position, the lock and the fastening means are grasped and held by the lateral spring clamps 31 and 43, respectively. During this movement of the carriage 19, the guide channel 21, which extends obliquely through the carriage, is also aligned with the outlet opening of the insertion channel 60 for the cable tie 2.

Figure 7D:
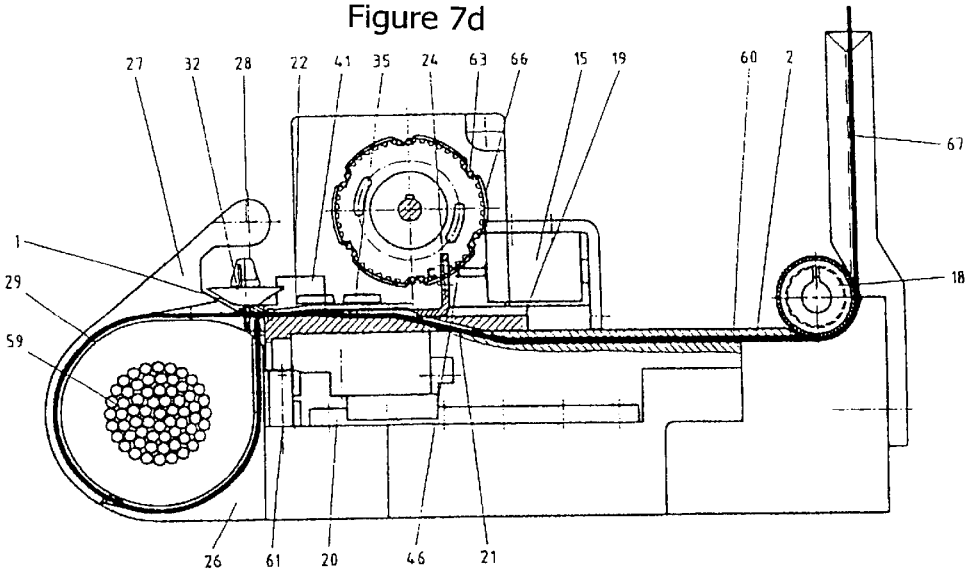
Figure 7E:
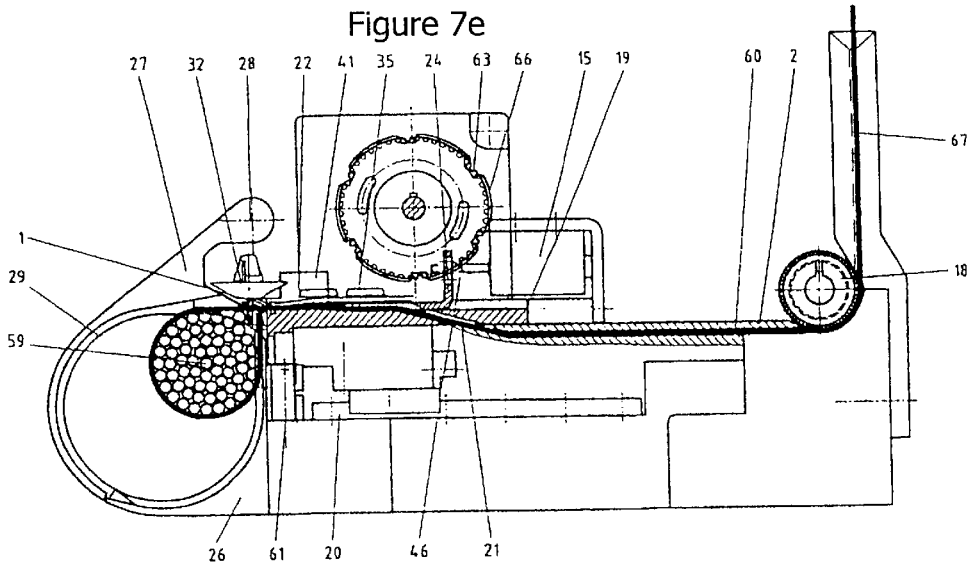
Figure 7F:
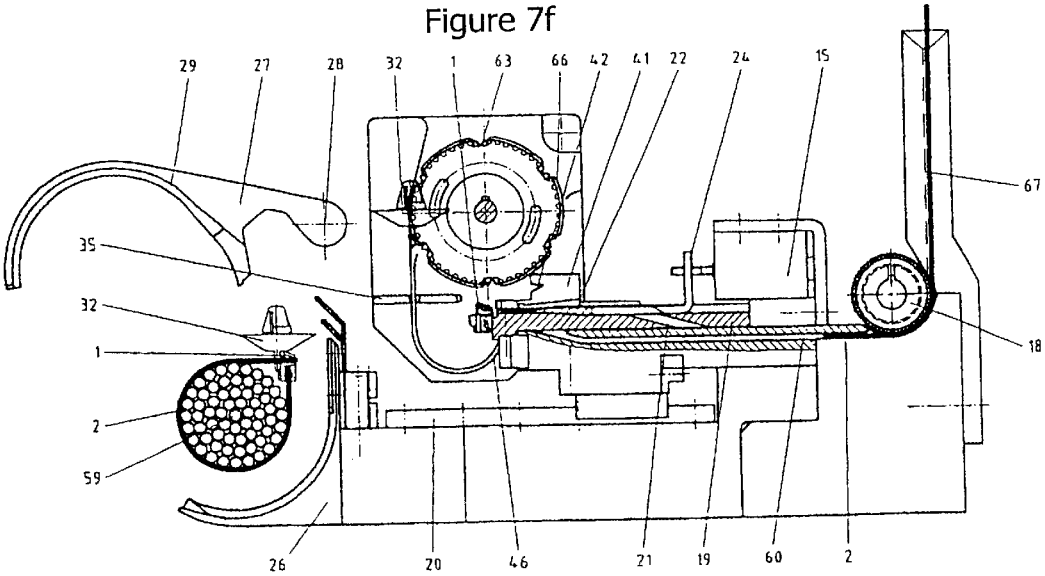

At the end of the forward movement of the carriage 19, the electromagnet 15 is activated in accordance with the program such that the slide 24 is moved forward on the carriage 19. During this process, the insertion tab 22 mounted on the slide is pushed underneath the first tooth 8 of the locking tab 6 in the through-channel 3 of the lock 1. Subsequently, the pinion 18 is driven by the external electric motor via the flexible shaft 17 and the cable tie 2 is pushed forward. Its leading end is pushed out of the insertion channel 60. through the guide channel 21 in the carriage 19, under the insertion tab 22, and through the through-channel 3 and the eyelet 38 in the head part 37 of the fastening means 32. The cable tie then reaches the guide groove 29 of the closed guide jaws 26, 27 surrounding the cables 59 to be bundled. The cable tie is pushed forward until its end reaches the insertion channel 4 of the lock 1 which is aligned with the outlet of the guide groove 29 in the guide jaw 26. The end of the cable tie then contacts the wall 5 located between the insertion channel 4 and the through-channel 3, and its teeth or grooves 10 engage the teeth 9 of the locking tab 7 of the insertion channel 4 (FIG. 7*d*).

The impact of the cable tie 2 in the insertion channel 4 can be determined by continuously measuring the power consumption of the driving motor. As an alternative or additional control, the displacement of the cable tie 2 may be measured. In this case, the distance by which the cable tie was advanced is determined. A light barrier may be provided laterally in the housing for this purpose, preferably at the starting position of the cable tie end in the insertion channel 60. The distance which the cable tie 2 needs to travel from this point through the guide channel 21 of the carriage 19 and the guide groove 29 of the guide jaws 26, 27 until it is reinserted into the lock 1 is constant. A signal that indicates when the end of the cable tie 2 is engaged in the insertion channel 4 of the lock 1 and cannot be additionally advanced can be generated from both measurements. Subsequently, the rotating direction of the motor is switched from feeding to tensioning. The slide 24 is simultaneously returned to its relative starting position on the carriage by the electromagnet 15 such that the locking tab 22 is retracted from the through-channel 3 and the locking tab 6 is able to subsequently engage the grooves 10 of the cable tie.

The cable tie 2 is pulled back through the through-channel 3 of the lock 1 in the direction of the teeth 8 until it pulls the cable bundle 59 (FIG. 7*e*) together tightly. This time is also determined by measuring the power consumption of the motor. The correlation of the desired tensile force to the required motor power can be experimentally determined and incorporated into the program control. After the desired tensile force is reached, the drive of the pinion 18 is stopped such that the cable tie 2 is no longer subjected to tension. The cutting device 47 (see FIG. 8) cuts the cable tie 2 just behind the lock 1 with the knife 48. The knife moves perpendicular to the plane of projection of FIGS. 5 and 7*e*. The cutting process can only be triggered once the tension of the cable tie 2 is removed.

Because the tension of the cable tie 2 is removed before the cutting process, it is ensured that the teeth 8 of the locking tab 6 in the through-channel 3 reliably engage the teeth or grooves 10 of the cable tie 2. Consequently, it is no longer possible for the cable tie 2 to jump over a tooth 8 of the locking tab 6 or to entirely jump out of the lock 1 after the cutting process due to still-present tension. In addition, the cable tie 2 is always cut at a defined position relative to the end face of the locking tab 6. This ensures that the advanced end of the cable tie 2 contacts the wall 5 in the insertion channel 4 of the lock 1 in a defined fashion during each subsequent binding process. That is, the advanced end of the cable tie reliably engages both teeth 9 of the locking tab 7 and the optimal effect of the lock is always achieved.

After the cable tie 2 is cut, it is returned to its starting position or zero position in the insertion channel 60 (FIG. 7*f*) and the carriage 19 as well as its slide 24 are returned to their starting positions. The guide jaws 26, 27 are manually opened and the device is moved to the next binding point.

In the previously described process, fastening means 32 for anchoring the cable bundle on a carrier part are attached at respective binding points simultaneously with the binding of the cables, i.e., in one production step. It is usually not required to attach the fastening means 32 at each binding point. The positions where fastening means 32 should be attached may be identified by a code that can be recognized by the sensor of the device. For this program control, the feeding of fastening means 32 can be interrupted when a certain code characteristic cannot be identified, and the feeding of fastening means is only restarted during the next binding process when the respective code is read. Consequently, fastening means 32 cannot be placed at incorrect positions.

If it is not intended or desired to anchor the cable bundle for a special application, the interchangeable module 33 can be removed from the device, and the device can be used for binding cables 59 in the condition shown in FIG. 6. In this case, a cover 34 is used instead of the interchangeable module 33 in order to protect the interior of the device from becoming soiled and damaged.

We claim:

1. A method for automatically binding cable bundles, comprising:

providing a cable tie having an elongated body terminating in a front end, the body having a surface with teeth defined thereon;

providing a cable tie lock having a locking channel with a first end and a second end, the lock being configured to engage the teeth of the cable tie;

feeding the front end of the cable tie in a first direction through the locking channel from the first end to the second end;

feeding a portion of the body of the cable tie through the locking channel and wrapping the cable tie around the cable bundles;

reinserting the front end of the cable tie into the lock;

retracting the body of the cable tie back through the locking channel such that the cable tie is tensioned in a second direction opposite the first direction;

stopping the retracting of the body of the cable tie such that the tension in the cable tie is removed at the first end of the locking channel; and cutting the cable tie adjacent the first end of the locking channel.

2. The method according to claim 1, wherein the feeding and retracting steps are performed by a drive motor operable to feed and retract the cable tie, the method further comprising:

measuring the power consumption or torque of the drive motor to determine when the front end of the cable tie is reinserted into the lock and subsequently performing the retracting step.

3. The method according to claim 1, wherein the feeding and retracting steps are performed by a drive motor operable to feed and retract the cable tie, the method further comprising:

measuring the power consumption or torque of the drive motor during the retracting step to determine the amount of tension in the cable tie and performing the stopping step when the tension reaches a predetermined level.

4. The method according to claim 1, further comprising the step of measuring the advance length of the cable tie that is fed in the first direction to determine when the front end of the cable tie is reinserted into the lock.

5. The method according to claim 1, wherein the cable tie lock comprises:

a body having a through-channel defined there through and an insertion channel defined therein, the insertion channel being open at one end and having an axis disposed at approximately 90 degrees to the axis of the through-channel, the body further having a partition wall separating the through-channel from the insertion channel.

6. The method according to claim 5, wherein the cable tie is provided from a supply roll and the front end is initially fed through the through-channel; then wound around the cable bundles to be bundled, and subsequently inserted into the insertion channel until the front end contacts the partition wall.

7. A device for automatically binding cable bundles with a cable tie and a lock, the cable tie having an elongated body with a surface having teeth defined thereon, and the lock having a locking channel for receiving the cable tie and a lock member for engaging the teeth on the cable tie, the device comprising:

a housing;

a carriage movably supported in the housing, the carriage having a guide channel for the cable tie and an insertion tab for lifting the lock member;

a pair of lateral holding jaws supported on a leading end of the carriage, the holding jaws configured to retain a lock in alignment with the guide channel in the carriage;

a pair of guide jaws mounted on the housing for surrounding the cable strands, the guide jaws having a closed position wherein the jaws cooperate to define a guide groove for the cable tie that if surrounds the cable bundles; and a lock feed operable to feed the locks to the lateral holding jaws from the top such that gravity assists the feed of the locks.

8. The device according to claim 7, wherein the carriage includes a slide, the insertion tab being mounted on the slide.

9. The device according to claim 7, wherein the lock feed comprises a supply tube entering the housing from the top, the supply tube having an opening aligned with the lateral holding jaws such that a lock from the supply tube falls into the jaws.

10. The device according to claim 7, wherein the device is further operable to provide fastening means on the cable ties during the binding operation, the fastening means having a head part with an eyelet defined there through, the device further comprising;

holding arrangements provided in the housing for supporting the fastening means with the head part of the fastening means downwardly such that the eyelet aligns with the through-channel in the lock retained in the holding jaws.

11. The device according to claim 10, wherein:

The housing includes an outlet opening, the device further comprising;

a first pair of holding clamps arranged on the housing adjacent the outlet opening, the first pair of clamps operable to hold the lock; and a second pair of holding clams arranged on the housing adjacent the outlet opening, the second pair of holding clamps operable to hold the fastening means.

12. A method for automatically binding cable bundles, comprising:

providing a continuously fed cable tie with teeth or grooves on one of its surfaces;

advancing the cable tie with a motor such that its front end is inserted into a lock that is provided with locking means for engaging the teeth or grooves of the cable tie;

winding the cable around a cable bundle and reinserting the cable tie into the lock; and tensioning the cable tie by reversing the direction of advancing, with the motor drive, cutting the tie behind the lock;

wherein the motor drive of the cable tie is stopped before the cable tie is cut such that the cable tie behind the lock is no longer subjected to tension.

13. The method according to claim 12, wherein the reversing of the drive motor for tensioning the cable tie takes place as a function of the measured power consumption or the measured torque of the drive motor and the stopping of the drive motor takes place as a function of the measured power consumption or the measured torque of the driving motor.

14. The method according to claim 12, wherein the reversing of the drive motor for tensioning the cable tie takes place as a function of the measured advance length of the cable tie.

15. The method according to claim 12, wherein the lock contains a through-channel and an insertion channel, the insertion channel being open on one side and offset by 90 degrees relative to the through-channel, the channels, each containing locking tabs that engage the teeth or grooves of the cable tie and the insertion channel being separated from the the through-channel by a partition wall;

the cable tie being unwound from a supply roll with the front end being initially inserted into the through-channel, then wound around the cables to be bundled and subsequently inserted into the insertion channel until the front end contacts the partition wall; and the changed power consumption of the drive motor resulting from the contact ofthe leading end of the cable tie on the partition wall being used as a signal for reversing the drive motor.

16. The method according to claim 12, wherein;

the lock contains a through-channel and an insertion channel, the insertion channel being open on one side and offset by 90 degrees relative to the through-channel, the channels each containing locking tabs that engage the teeth or grooves of the cable tie, and the insertion channel being separated from the through-channel by a partition wall;

the cable tie being unwound from a supply roll with the front end being initially inserted into the through-channel, then wound around the cables to be bundled and subsequently inserted into the insertion channel until the front end contacts the partition wall, and the advance length of the cable tie which is required for the leading end of the cable tie to contact the partition wall from a certain starting position is used as a control or signal value for reversing the drive motor.

17. The method according to claim 12 wherein, after reversing the drive motor, the power consumption of the drive motor corresponding to a certain tension of the cable tie is used as a signal for interrupting the drive of the cable tie.

18. An automatically operating device for binding cable bundles with a continuously fed cable tie having teeth or grooves on one of its surfaces, the device being of the type:

wherein the cable tie is tensioned in a lock after it is looped around the cable bundles; engage the teeth or grooves of the cable tie;

wherein the individual cable ties are cut behind the respective lock after the looping and tensioning process is completed;

wherein the device includes;

guide jaws that surround the cable bundle is a manner similar to tongs, the guide jaws having a guide groove for the cable tie;

a carriage that can be moved back and forth in the device and contains a guide channel for the cable tie as well as an insertion tab for lifting the locking means in the insertion direction in the lock;

one lock being positioned at an outlet opening of the device that ends in the guide groove of the guide jaws by the carriage that is moved forward when actuated;

the cable tie being advanced in a motor-driven fashion and guided through the lock, looped around the cable bundle by the guide jaws and reinserted into the lock;

the cable tie being tensioned by a drive motor after the reinserted end of the cable tie is engaged in the lock; and the cable tie being interlocked with the locking means of the lock after the return movement of the insertion tab and cut by a cutting device that can be moved perpendicular to the direction of advance behind the lock;

wherein lateral holding jaws are provided on the leading end of the carriage, the lock that including a through-channel and an insertion channel open toward the bottom and offset by 90° relative to the through-channel, the lock being fed from the top between the lateral holding jaws, wherein the through-channel and the insertion channel contain locking tabs for engaging the teeth or grooves of the cable tie, and wherein the insertion channel is separated from the through-channel by a partition wall;

the through-channel of the lock being aligned with the insertion tab in its position between the holding jaws;

the lock being held between the holding jaws can be placed in the outlet opening of the housing at the end of the forward movement of the carriage in such a way that, in the closed position of the guide jaws, the inlet end of the guide groove in the guide jaws is aligned with the through-channel and the outlet end of said guide groove is aligned with the insertion channel of the lock and that the insertion tab can be inserted into the through-channel in order to lift the locking tab in such a way that the cable tie can be advanced in a motor-driven fashion through the through-channel, underneath the insertion tab, and along the guide groove until it is inserted into the insertion channel in order to engage the locking tab of the insertion channel.

19. The device according to claim 18, wherein the insertion tab is rigidly connected to a slide that can be moved on the carriage.

20. The device according to claim 18 wherein the guide channel for the cable tie obliquely extends through the carriage, the outlet opening of the guide channel which ends on the upper side of the carriage is covered by the insertion tab and the inlet opening of the channel which is located on the underside of the carriage coincides with the outlet opening of an insertion channel in a stationary housing part in the advanced position of the carriage.

21. The device according to claim 18, wherein a supply tube for the locks leads into the device from the top, and the opening of the supply tube is located directly above the space defined by the holding jaws of the carriage.

22. The device according to claim 18, wherein holding arrangements are provided in the housing on both sides of the outlet opening fastening means for fastening the cable bundles on a carrier part being fed from above and placed onto the holding arrangements, and a head part of the fastening means protruding downwardly into the moving path of the carriage through the holding arrangements, the head part containing an eyelet that is aligned with the through-channel of the lock, and the fastening means can be grasped and advanced into the position in the outlet opening by the carriage during its forward movement.

23. The device according to claim 22, wherein a driver is provided on the carriage, the driver engaging a protruding collar of the fastening means during the forward movement of the carriage.

24. The device according to claim 22, wherein a first pair of holding clamps for the lock and a second pair of holding clamps for the fastening means are arranged in the housing on both sides of the outlet opening.

25. The device according to claim 22, wherein the device for feeding fastening means includes an ejection channel for transport strips that are separated from the fastening means and is arranged in an interchangeable module that can be removed from the device.

26. The device according to claim 22, wherein the guide jaws can be manually closed and opened in order to surround the cables to be bundled, and all additional production steps of the device are program-controlled after a trigger is actuated.

27. The device according to claim 22, wherein a light barrier is provided within the region of the start position or zero position of the cable tie in order to measure the advance length of the cable tie.

28. A method for operating a device according to claim 22, comprising the following sequence of production steps:

initiating an operating cycle after a sensor has recognized a binding point for a cable bundle, with a lock being placed between the holding jaws of the carriage;

releasing or blocking the supply of fastening means after the sensor has recognized a mounting point for the cable bundle on a carrier part;

advancing the carriage to the working position of the lock and, if applicable, to that of the fastening means;

advancing the slide on the carriage and inserting the insertion tab into the through-channel of the positioned lock;

advancing the cable tie until it is inserted into the insertion channel and engaged with the locking means provided therein, during which a continuous measurement of the power consumption of the drive motor for cable tie takes place;

switching the drive motor from feeding to tensioning as a function of the measured value, during which the continuous measurement of the power consumption of the drive motor continues;

returning the slide to its relative starting position on the carriage;

stopping the drive motor as a function of the measured value in order to remove the tension in the cable tie behind the lock;

actuating the cutting device for cutting the cable tie behind the lock;

pulling the cable tie back to its starting position; and returning the carriage to its starting position.

* * * * *

UNITED STATES PATENT AND TRADEMARK OFFICE

CERTIFICATE OF CORRECTION

PATENT NO. : 6,513,555 B1
DATED : February 4, 2003
INVENTOR(S) : Lesser et al.

It is certified that error appears in the above-identified patent and that said Letters Patent is hereby corrected as shown below:

Column 3,
Line 11, replace “the. advance” with -- the advance --.

Column 4,
Line 24, replace “and if” with -- and, if --.

Column 7,
Line 27, replace “setbreaking” with -- set-breaking --.

Column 8,
Line 64, replace “60.” with -- 60; --.

Column 11,
Line 29, replace “that if” with -- that --.
Line 56, no paragraph after “pair”.
Line 57, after “lock;” start a new paragraph.

Column 12,
Line 33, replace “of the” with -- of the --.
Lines 63-64, delete “engage the teeth or grooves of the cable tie” and insert -- wherein the locks are continuously fed in series and provided with locking means that can engage the teeth or grooves of the cable tie; --.

Column 13,
Line 17, no paragraph after “engaged”
Line 18, insert a new paragraph after “lock;”
Line 57, replace “of the channel” with -- of the guide channel --.

Signed and Sealed this

Nineteenth Day of August, 2003

JAMES E. ROGAN
*Director of the United States Patent and Trademark Office*